US006260943B1

(12) United States Patent
Ishikawa

(10) Patent No.: US 6,260,943 B1
(45) Date of Patent: Jul. 17, 2001

(54) INK-JET PRINTING APPARATUS WITH MULTI-POSITION CAP

(75) Inventor: Tetsuya Ishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/237,245

(22) Filed: Jan. 26, 1999

(30) Foreign Application Priority Data

Jan. 30, 1998 (JP) ..... 10-019507

(51) Int. Cl.[7] ..... B41J 2/165
(52) U.S. Cl. ..... 347/32; 347/29
(58) Field of Search ..... 347/29–31, 32

(56) References Cited

U.S. PATENT DOCUMENTS 4,967,204 * 10/1990 Terasawa et al. ..... 347/30
5,712,668 * 1/1998 Osborne et al. ..... 347/32
5,903,287 5/1999 Ishikawa et al. ..... 347/24
5,966,146 * 10/1999 Lee ..... 347/33
6,007,180 * 12/1999 Muraki ..... 347/32

* cited by examiner

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

An ink-jet printing apparatus including a cap for capping an ink ejection opening for ejecting ink provided on a head surface of an ink-jet printing head by contacting a capping surface of the cap onto the head surface, a cap supporting member for supporting the cap to move the cap between an open state and a closed state against the head surface of the ink-jet printing head by rotating on an axis, and the posture of the cap being controlled for placing the capping surface in parallel to the head surface at least at a first position and at a second position different from the first position, the first position and the second position being in the open state of the cap.

10 Claims, 18 Drawing Sheets

INK-JET PRINTING APPARATUS WITH MULTI-POSITION CAP

This application is based on Patent Application No. 19507/1998 filed on Jan. 30, 1998 in Japan, the content of which is incorporated hereinto by reference.

BACKGROUND OF THE INVENTION

1. Field of the Invention

The present invention relates generally to an ink-jet printing apparatus, more particularly to an ink-jet printing apparatus performing the printing by ejecting an ink from a printing head toward a printing medium.

2. Description of the Related Art

Conventionally, in an ink-jet printing apparatus performing the printing by ejecting an ink from an ink ejection opening of a printing head toward a printing medium, means for protecting the ejection opening and the ejection recovery processing means are provided for solving the problems of plugging of the ink ejecting opening portion of the printing head due to the drying or ejection failure of the ink due to the dart, the bubble or the like within the ink ejection opening.

Here, throughout the disclosure, the words "ejection recovery" represents not only for resolving of the problem of the ejection failure but also, in the broader sense, for maintaining appropriately the ejection performance of the ink in the ink ejection opening of the printing head.

Major construction of such ink ejection protecting means is a cap formed with an elastic material, such as rubber or the like. The cap covers an ejection opening forming surface formed on the printing head (hereinafter occasionally referred to simply as "head"). Major construction and function of the ejection recovery processing means is to suck air within the cap by a vacuum generating means, such as a pump or the like to reduce the pressure therein for causing the forced discharge of the ink through the ejection opening and whereby to resolve the problem of the ejection failure of the ink.

Furthermore, another ejection recovery means is a preparatory ejection process for ejecting the ink from the head for a predetermined times for elimination of cause of the ejection failure. In this preparatory ejection process, it is typical to use the cap as a receptacle for ejected ink. The reason is that, by using the existing cap as the receptacle, it becomes unnecessary to provide special ink receptacle means to permit down-sizing by space saving or cost-down.

Furthermore, as a mechanism for moving the cap between an open condition (a condition moved away from the ejection opening forming surface of the head) and a closed condition (a condition where the head and the ejection opening forming surface are in contact), it is typical to pivot the cap about a cap supporting member or a pivot center. Advantage of employment of the method set forth above is that the down-sizing is possible and the high precise control of the relative position between the ejection opening forming surface of the head and the cap can be easily performed.

Furthermore, when the relatively high precision is required in the positional relationship between the cap and the head in order to certainly cover the ejection opening forming surface of the head with the cap and certainly maintaining sealing ability with the ejection opening forming surface, it is possible to provide a relative positioning means respectively for a head unit (including a carriage and so on) and a cap unit (including the cap supporting member and so on). As one example, the relative positioning of the cap and the head can be certainly performed by providing a positioning boss in the cap supporting member and a positioning hole, in which the positioning boss is inserted, in the carriage.

However, when the conventional method is used, in order to place the cap in an open condition, namely in a condition where the cap unit is placed away from the head unit, a necessary magnitude of pivoting of the cap supporting member inherently becomes large. Particularly, when a projection, such as a boss-shaped projection or the like is provided as the positioning means, this tendency becomes significant to hinder the down-sizing of the printing apparatus.

Another reason is that the accurate positioning is difficult unless the posture of the cap upon the positioning is in a parallel position to the posture of the cap in the capping position.

SUMMARY OF THE INVENTION

In order to solve such problems in the prior art, it is an object of the present invention to provide an ink-jet printing apparatus which can accurately position a head unit and a cap unit at a desired posture upon the opening and closing of the cap.

It is another object of the present invention to provide an ink-jet printing apparatus comprising a cap for covering a surface in which the ink ejection openings of an ink-jet printing head is formed, a cap supporting member pivoted with holding of the cap for opening or closing the ink-jet printing head, and posture control means for controlling posture of the cap for placing the cap in parallel to the surface at least at first and second positions between opening state and closing state of the cap.

Also, an ink-jet printing apparatus of the present invention is characterized in that the first position is a position at a cap opening state and a second position is a position at initiating state of positioning for the cap with respect to the surface for performing the cap closing.

Furthermore, an ink-jet printing apparatus of the present invention is characterized in that the posture control means includes rocking means provided on the cap supporting member for rocking the cap, rotational moment applying means for applying a rotational moment to the cap for rocking motion of the cap about a rocking center of the rocking means, a first stopper for stopping the cap at the first position with respect to the ink-jet printing head by restricting rocking motion by the rotational moment in the cap opening during the cap is substantially in the cap opening state, and a second stopper for stopping the cap at the second position by restricting rocking motion by the rotational moment in the cap closing state during the cap is substantially in the cap closing state.

Stillmore, an ink-jet printing apparatus of the present invention is characterized in that further comprises positioning means for performing relative positioning of the cap and the ink-jet printing head.

An ink-jet printing apparatus of the present invention is characterized in that the relative positioning means has projecting member on one of the capping unit or the head unit and a hole portion, in which the projecting member is inserted, on the other of the capping unit or the head unit.

Also, an ink-jet printing apparatus of the present invention is characterized in that the rotational moment by the rotational moment applying means is applied by a spring.

Furthermore, an ink-jet printing apparatus of the present invention is characterized in that further comprises means as ejection recovery means for the ink-jet printing head, for performing preparatory ejection by the ink-jet printing head at the first position, in which the preparatory ejected ink is received within the cap.

Stillmore, an ink-jet printing apparatus of the present invention is characterized in that the ejection recovery means has means for discharging ink from the ejection opening by acting a suction force via the cap.

An ink-jet printing apparatus of the present invention is characterized in that the ink-jet printing head has an electrothermal transducer generating a thermal energy in response to application of an electric power to be used for ink ejection.

Also, an ink-jet printing apparatus of the present invention is characterized in that the ink-jet printing head performs ejection of an ink toward a printing medium through the ejection openings, utilizing film boiling caused in the ink by thermal energy to be applied by the electromagnetic transducer.

As set forth above, in the present invention, the ink-jet printing apparatus can restrict necessary pivoting magnitude of the cap supporting member upon opening and closing the cap, to be minimum by the above construction. Also, it is possible to take a construction in which the cap is placed in a condition parallel to the head at least twice in a transition state from a cap opening state to a cap closing state. Accordingly, the space saving of the printing apparatus can be realized. Furthermore, upon the positioning of the head unit and the cap unit, the cap or a part of the cap unit (including members associated with the positioning) and the head or a part of the head unit (including members associated with the positioning) can be placed in a parallel relationship relative to each other to improve the performances in the preparatory ejection and positioning.

In the present invention, upon an instant of performing the preparatory ejection into the cap or upon relative positioning between the cap unit and the head unit, it is desirable that the head unit and the cap unit are placed in a substantially parallel relationship each other. The reason is that, upon the preparatory ejection, an area where an ink receptacle portion of the cap is projected toward the head, is preferred to be as large as possible in order to certainly receive the ink.

It should be noted that the parallel condition of the cap relative to the ejection opening forming surface, which the present invention refers to, is referred not only to a physically parallel relationship with at least a part of the component but also an posture desired for performing the functions to be performed by the ink-jet printing apparatus, such as an initiation of the positioning of the cap unit and the head unit for certainly obtaining the closed state and performing the preparatory ejection and so on, as in the foregoing example.

The above and other objects, effects, features and advantages of the present invention will become more apparent from the following description of the embodiments thereof taken in conjunction with the accompanying drawings.

DETAILED DESCRIPTION OF THE PREFERRED EMBODIMENTS

Figure 1:
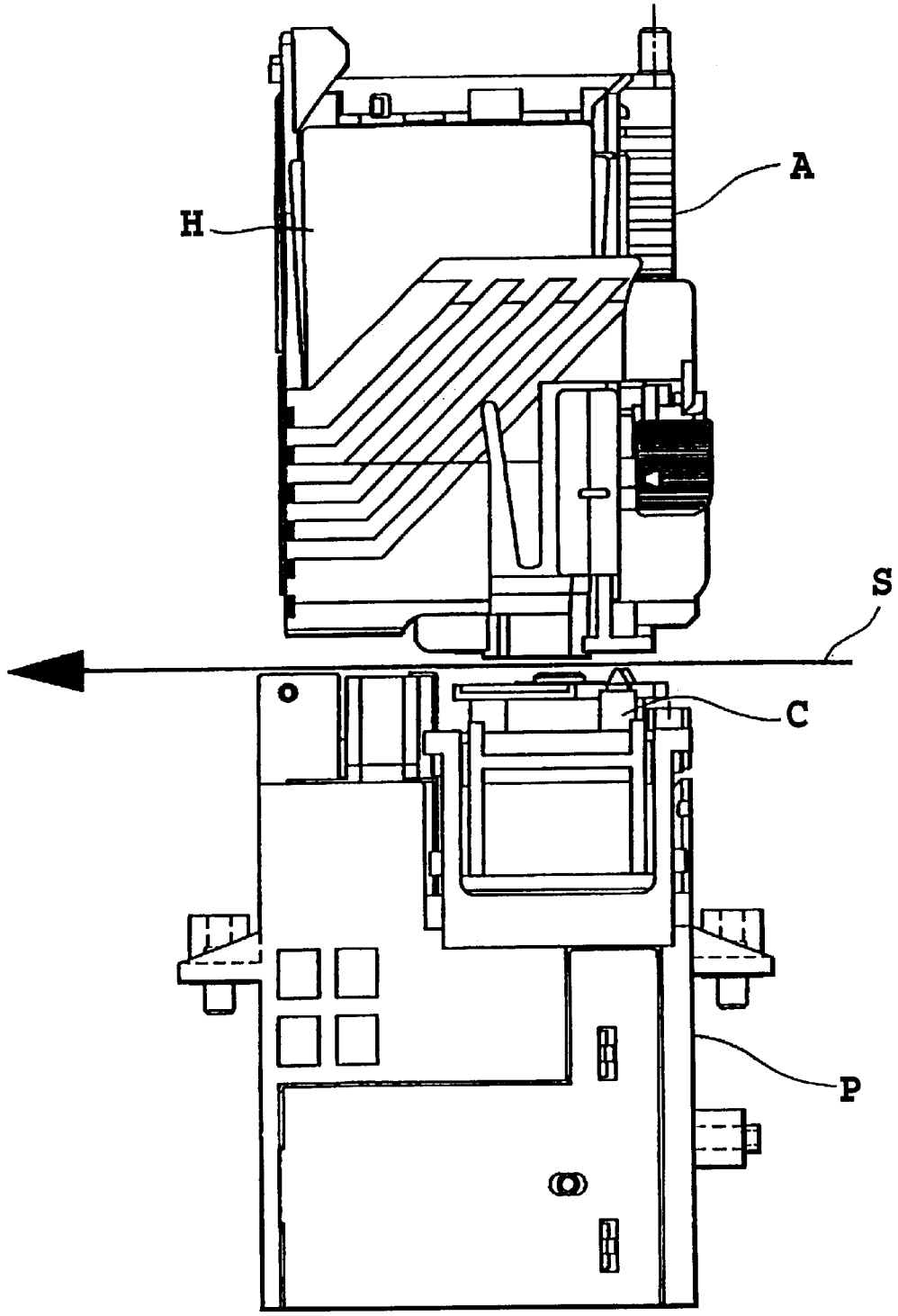
FIG. 1 is a front elevation showing an ink-jet printing apparatus according to the present invention.

The preferred embodiments of an ink-jet printing apparatus according to the present invention will be explained hereinafter in detail with reference to the drawings. Throughout the disclosure and the drawings, like components are identified by like reference numerals.

FIG. 1 is a front elevation of a general portion of the ink-jet printing apparatus carrying out the present invention. The reference sign A denotes a head unit mounting a printing head H, and the reference sign P denotes an ejection recovery processing apparatus according to the present invention. The reference sign S denotes a printing medium to be fed by a transporting system. When the printing medium S passes under the lower side of the head unit A, an ink ejected from the ink ejection openings formed in the printing head H is applied to the printing medium. Also, the reference sign C denotes a cap unit according to the present invention.

It should be noted that, the printing head H in the present invention is used with the type of which has an electrothermal transducer generating a thermal energy as energy to be used for performing ink ejection to perform ink ejection by causing the state variation associated with the film boiling by the thermal energy generated in response to the application of an electric power. On the other hand, the printing heads may be provided in number corresponding to number if the inks for the different colors or the densities (the color tones). In the alternative, a printing head, in which the head elements for a plurality of color tones are integrated, or the respectively separate ink ejecting portions are provided for the respective color tones, may also be employed. Furthermore, as the ink ejecting portion, a plurality of ejection openings are aligned in an appropriate direction.

Figure 2:
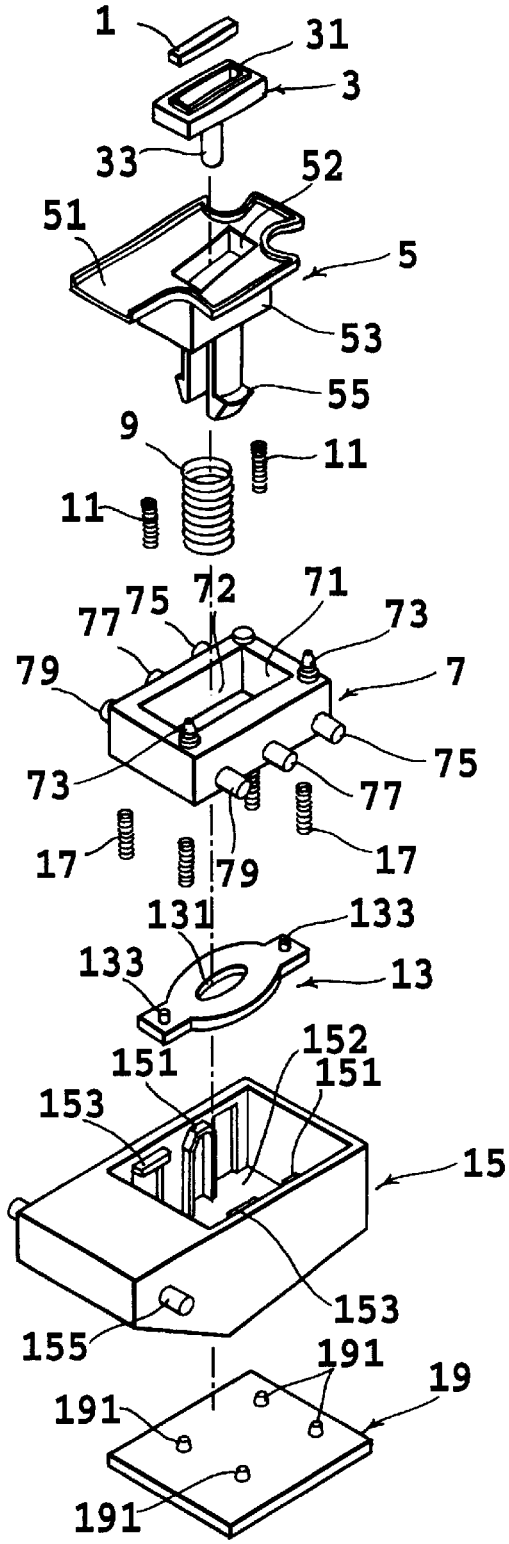
FIG. 2 is an exploded perspective view showing a construction of a cap unit portion according to the present invention.

FIG. 2 shows one example of a construction of the major part of the ink-jet printing apparatus according to the present invention, and is an exploded perspective view of the cap unit C. Also, it should be noted that portions which may be neglected from explanation for describing the present invention, such as hooking portions for coupling between parts, and so on, are neglected from the following disclosure.

As shown in FIG. 2, the cap unit C is constructed with a cap 3 installed within an absorbing body 1, a cap holder 5 for supporting the cap 3, a cap spring 9 and a cap down spring 11 elastically supporting the cap holder 5, a cap guide 7 supporting the cap holder 5 supporting the cap 3 and guiding in the vertical direction in FIG. 2, a plurality of cap casing springs 17 elastically supporting the cap guide 7, a cap casing 15 supported pivotably and a bottom plate 19 provided for closing the bottom portion of the cap casing 15.

The absorbing body 1 installed within the cap 3 is for minimizing an amount of the ink residing within the cap 3 upon a so-called ejection recovery operation by generating the vacuum within the cap by means of an appropriate vacuum generating means to cause the forced discharge of the ink from the ink ejection openings of the head. Also, the cap 3 is formed with an elastic material, such as chlorinated butyl rubber or the like. The cap 3 is provided with a rib 31 contacting around the circumference of the ejection opening forming region of the printing head H and a tube portion 33 forming a flow passage communicated with not shown vacuum generating means. While not shown in the drawing, to the tube portion 33, a silicon rubber tube communicated with the vacuum generating means is connected via a joint made of resin.

The cap holder 5 for fixedly supporting the cap 3 is provided with a color portion 51, an opening 52 for the cap 3, an outer peripheral surface 53 slidably engaged with the cap guide 7 and a claw portion 55, for preventing the deposition of the paper dust, the ink mist and so on a sliding portion by the cover portion 51. The outer peripheral surface 53 is formed in to a rectangular shaped configuration projected downwardly from the bottom surface of the cover portion 51 to be engaged with an opening portion 72 of the corresponding cap guide for slidably engaged with an inner peripheral surface 71. Thus, the cap 3 is installed in the opening 52 of the cap holder 5.

The cap guide 7 is constructed with an inner peripheral surface 71 provided to form an opening 72 engaged with the outer peripheral surface 53 of the cap holder 5, a positioning pin 73 as a projecting ember provided in a corner portion of an upper surface, and a plurality of guide bosses 75, 77 and 79 projecting into the lateral direction from the left and right side surfaces thereof. The cap guide 7 is formed movable in the vertical direction relative to the cap holder 5 by sliding of the inner peripheral surface 71 and an outer peripheral surface 53 of the cap holder 5.

Furthermore, the positioning pin 73 is provided for positioning between the cap 3 and an ink ejection opening forming surface H1 of the head unit A by inserting positioning hole portions 211 and 213 (one of the hole portion being preferably an elongated hole) of a diameter of 3 mm provided in a carriage 21 (FIG. 3) of the head unit A which will be explained hereafter. The positioning pin 73 is formed to have a diameter of 3 mm at its route portion and a diameter of 0.5 mm at its tip end portion. When a positioning error between the hole portions 211 and 213 and the positioning pins 73 is less than or equal to 1.25 mm, the cap guide 7 can be moved relative to the cap casing 15 for positioning due to the construction described hereafter. It should be noted that while the positioning pin 73 employed in the shown embodiment of the present invention is formed with a stainless steel only in a pin portion and with a polyacetal resin in the remaining portion, for example, it can be formed with various equivalent materials.

The cap spring 9 resiliently supports the cap holder 5, in which the cap 3 is installed to sealingly fit the rib 31 by depressing the cap 3 toward the ejection opening forming surface H1 of the head H with a predetermined load. In the shown embodiment, the nominal value of the load to be applied to the cap 3 is set at 280 gf. Also, the cap spring 9 is stretched between the cap holder 5 and the cap plate 13 with hooking the claw portion 55 in the hole portion 131 of the cap plate 13. Thus, the cap spring 9 is assembled between the cap holder 5 and the cap plate 13 in a condition deflected in a predetermined amount.

The cap down spring 11 is stretched between a boss 74 provided on the back surface, namely the lower surface, of the cap guide 7, and a boss 133 provided in the cap plate 13. The cap down spring 11 is provided for applying a spring force in a direction for depressing the cap holder 5 relative to the cap guide 7. Also, the cap down spring 11 serves for avoiding the problem that the cap opening cannot be performed normally when the ink residing between the cap 3 and the head H is hardened by leaving for a long period, when the vacuum is applied by the not shown vacuum generating means within the cap as the recovery process, and when the cap 3 is affixed or sucked onto the head H.

The cap casing 15 is formed as a pivotable cap supporting member and is provided with a guide portion 151 and a stopper 153 on the opposite dies of an inner peripheral surface of an opening portion 152. The guide portion 151 engages or contacts with a guide boss 77 provided in the cap guide 7 for pivoting the cap guide 7 thereabout to control the cap guide 7 at the desired position or desired condition. Also, the stopper 153 serves as a second stopper for holding the cap 3 in a horizontal state at the second position by contacting with a guide boss 79 provided on the cap guide 7. Furthermore, on side of the cap casing 15, the laterally extending boss portion 155 is provided for forming one member of the pivoting means pivotably supporting the cap casing 15 on a bearing portion 271 which will be explained hereafter.

A plurality of cap casing springs 17 apply rotational moment to the cap guide 7 for pivoting about the guide boss 77 and vertically move the cap guide 7 upon the cap opening and closing, to form a rotational moment applying means. In the shown embodiment, the cap casing spring 17 is set at 17.5 gf when the nominal value is 11.3 mm, and a spring constant is set at 5.3 gf/mm.

The bottom plate 19 forms the bottom surface of the cap casing 15. A boss 191 is formed on its upper surface side to serve as a receptacle portion of the cap casing spring 17 or a receptacle portion of the capping plate 19. Also, a contact surface 171 for the capping cam 23 which will be explained hereafter is also formed on the back surface side of the bottom plate 19.

Figure 3:
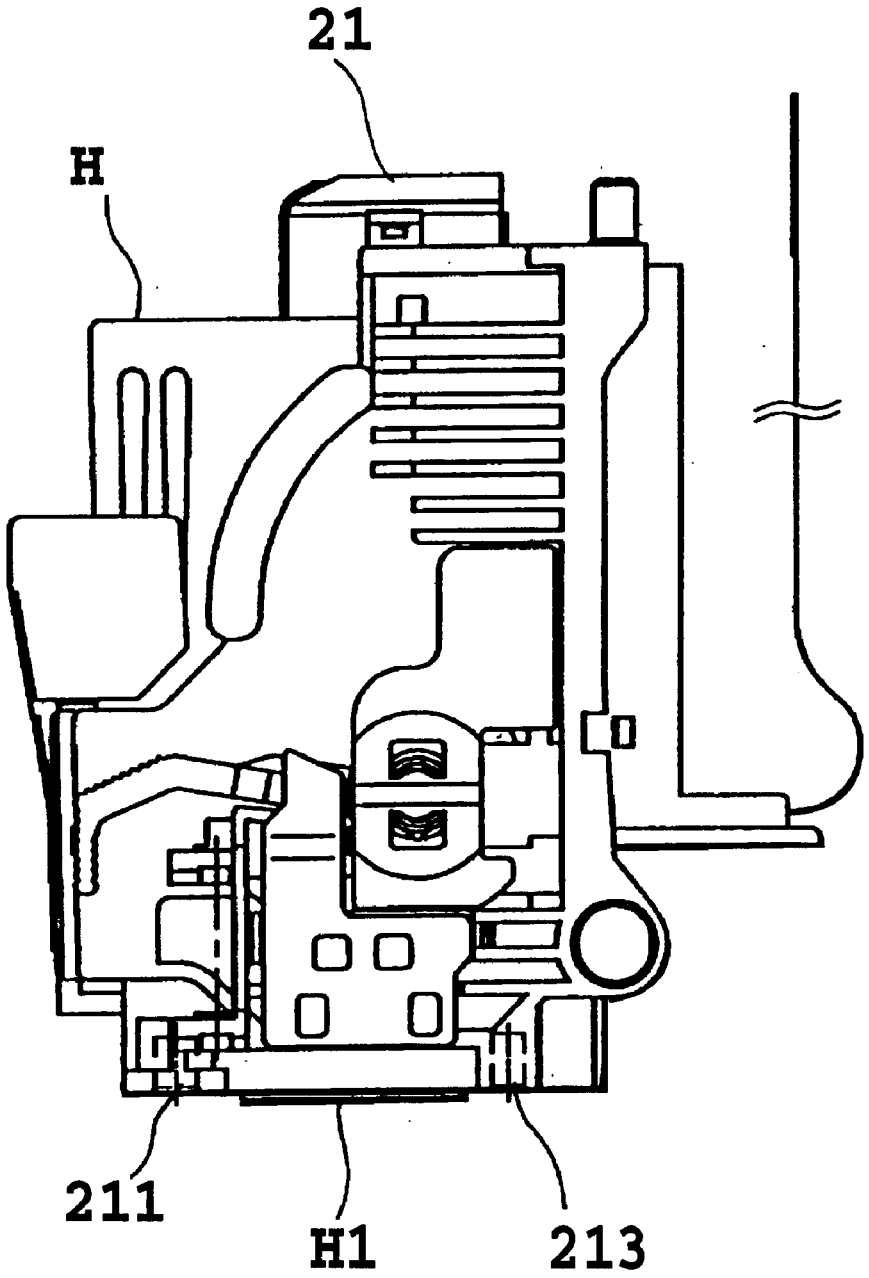
FIG. 3 is a side elevation of a head unit (a carriage mounting a head)

FIG. 3 is a side elevation of the carriage 21 mounting the printing head H of the ink-jet printing apparatus, in which H1 is the surface formed with the ejection openings. Also, the reference numerals 211 and 213 illustrated by dotted lines denote positioning hole portions provided in the carriage 21 so that the positioning pins 73 provided on the cap guide 7 are inserted upon the cap closing.

Next, the state transition of the cap 3 from the cap closing state to the cap opening state will be explained with reference to FIGS. 4 to 7.

Figure 4:
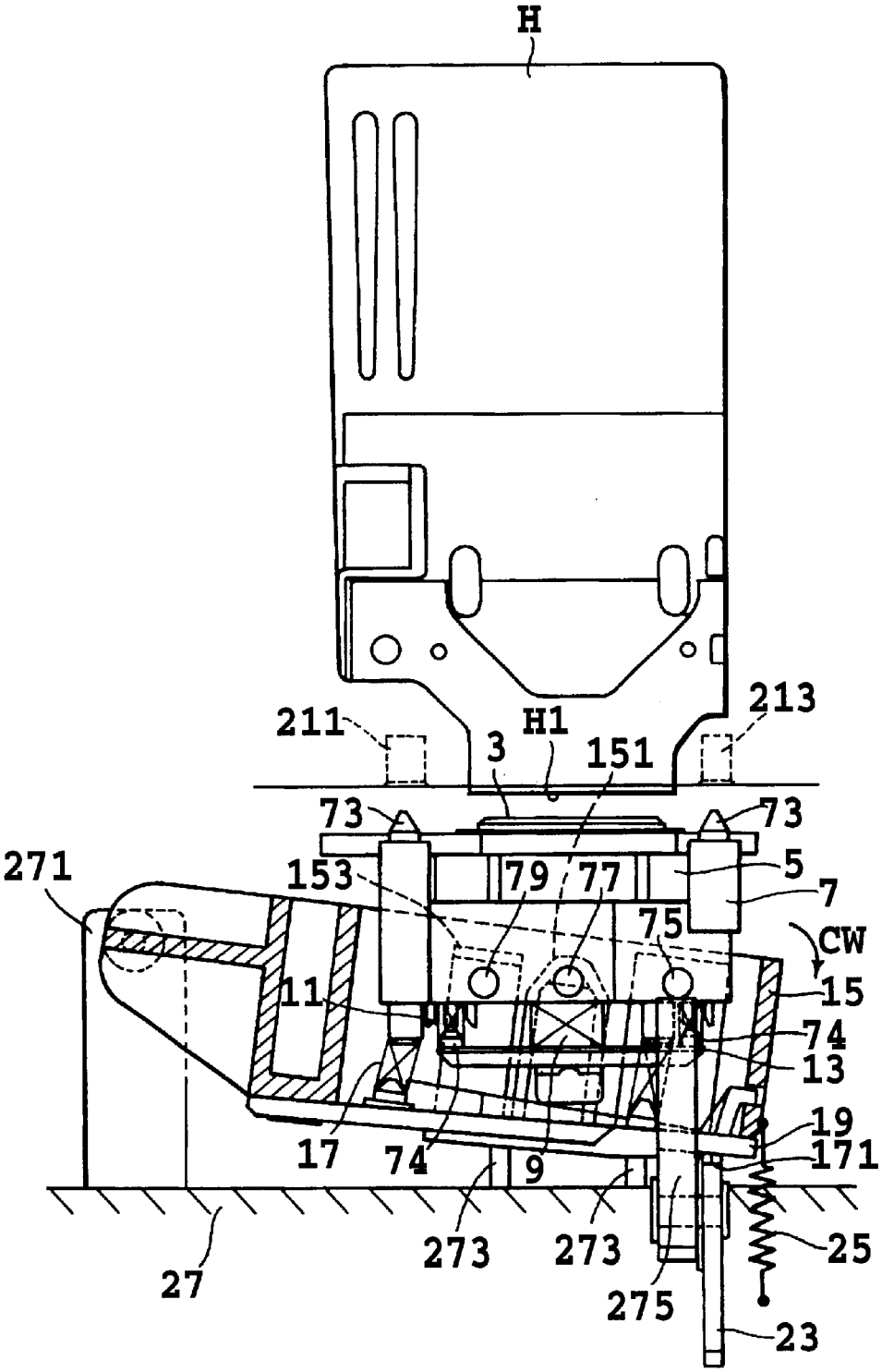
FIG. 4 is a side elevation of a cap unit at a cap opening state.

FIG. 4 is an illustration showing the cap opening state. The capping cam 23 is a member, in which a cam varying a dimension in the radial direction in a range from 5.7 mm to 15.5 mm in one turn is integrated with a gear. The reference numeral 25 denotes a cap opening spring for depressing downwardly the cap casing 15 to the lowermost point against the loads of the cap casing spring 17 and the cap down spring 11. Also, the reference numeral 27 denotes a pump base which is a member for mounting the cap unit C and, in conjunction therewith, for mounting the motor and the gear train and so on as a driving power source for vertically moving the cap 3. Furthermore, the reference numeral 271 denotes a bearing portion pivotably supporting the boss portion 155 serving as a pivot center of the cap casing 15, 273 denotes a rib for restricting the height of the cap 3 at a desired position by supporting the capping plate 13 at a predetermined height upon the cap opening, and 275 denotes a first stopper for restricting the pivot motion of the cap guide 7 upon the cap opening. Here, the cap guide receives the rotational moment in a clockwise (CW) direction in the drawing (calculation for proving will be explained hereafter). However, since the pivotal movement caused by this rotational moment is stopped at a position where the first stopper 275 contacts with the guide post 75, the cap guide 7 is placed in parallel with the ejection opening forming surface H1. Thus, the cap 3 is also placed in parallel. Therefore, it can be understood that the cap 3 and the pin 73 which require the large pivoting angle for moving the cap 3 away from the head in a simple pivoting as in the prior art, can be satisfactorily moved away from the head with the smaller magnitude of the pivotal movement.

Also, the cap plate 13 is pushed up to the predetermined height by the rib 273, and a gap between the cap plate 13 and the ejection opening forming surface H1 is restricted about 2.2 mm. Therefore, the flying of the ink droplet due to the excessively large distance to the hitting position during the preparatory ejection and, conversely, the occurrence of the ink mist to be generated by rebounding of the ink can be restricted to be minimum. It should be noted that, in subsequent FIGS. 5 to 7, the external views of the spring, the capping cam and so on are neglected from the illustration as long as the explanation is not hindered.

Figure 5:
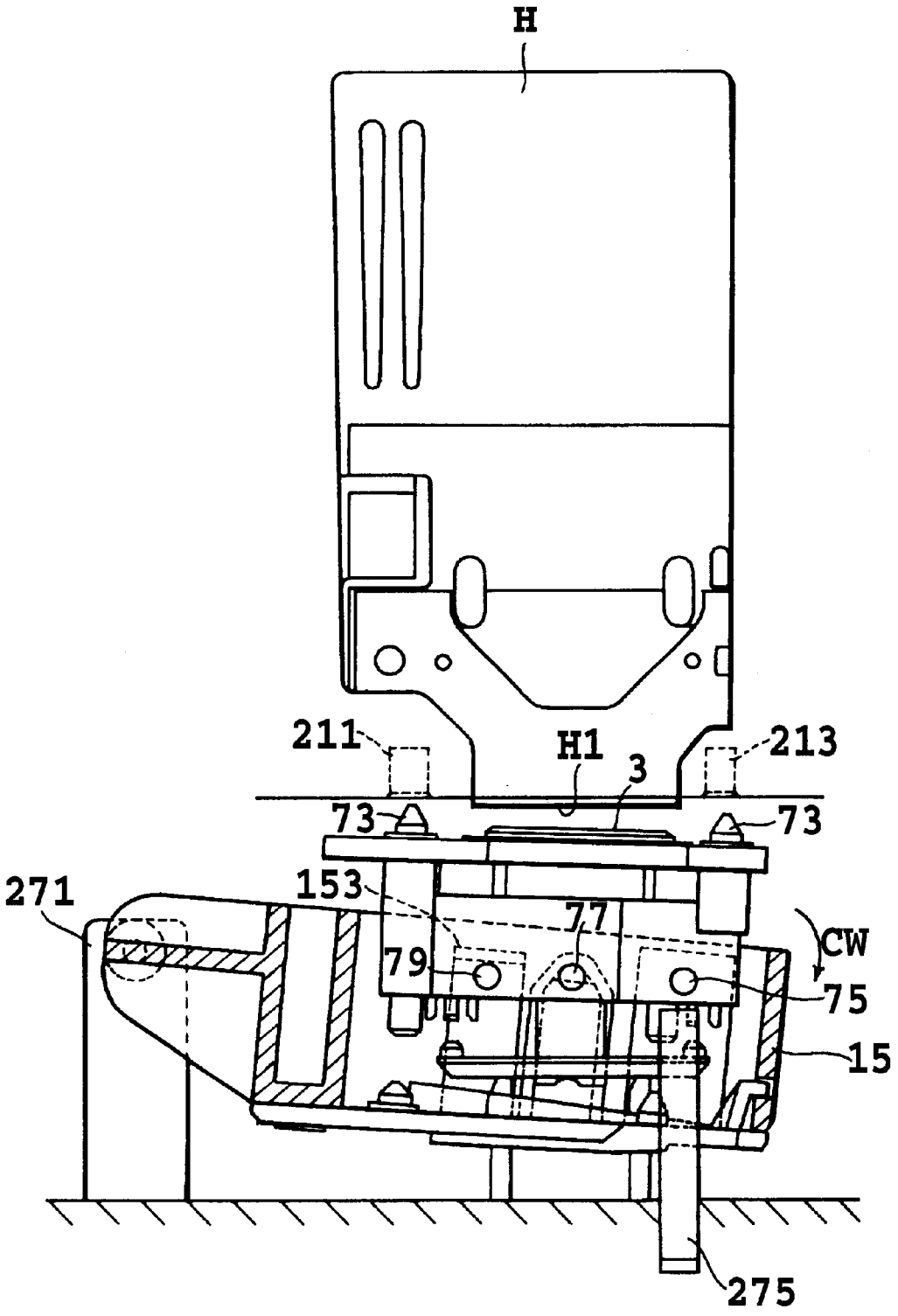
FIG. 5 is a side elevation of the cap unit.

FIG. 5 shows a condition where the cap casing 15 initiates a motion and is slightly displaced from the cap opening state toward the cap closing state. Here, the guide boss 75 starts to move away from the first stopper 275 and pivots in the clockwise (CW) direction about the guide boss 77. Then, the guide boss 79 contacts with the second stopper 153.

Figure 6:
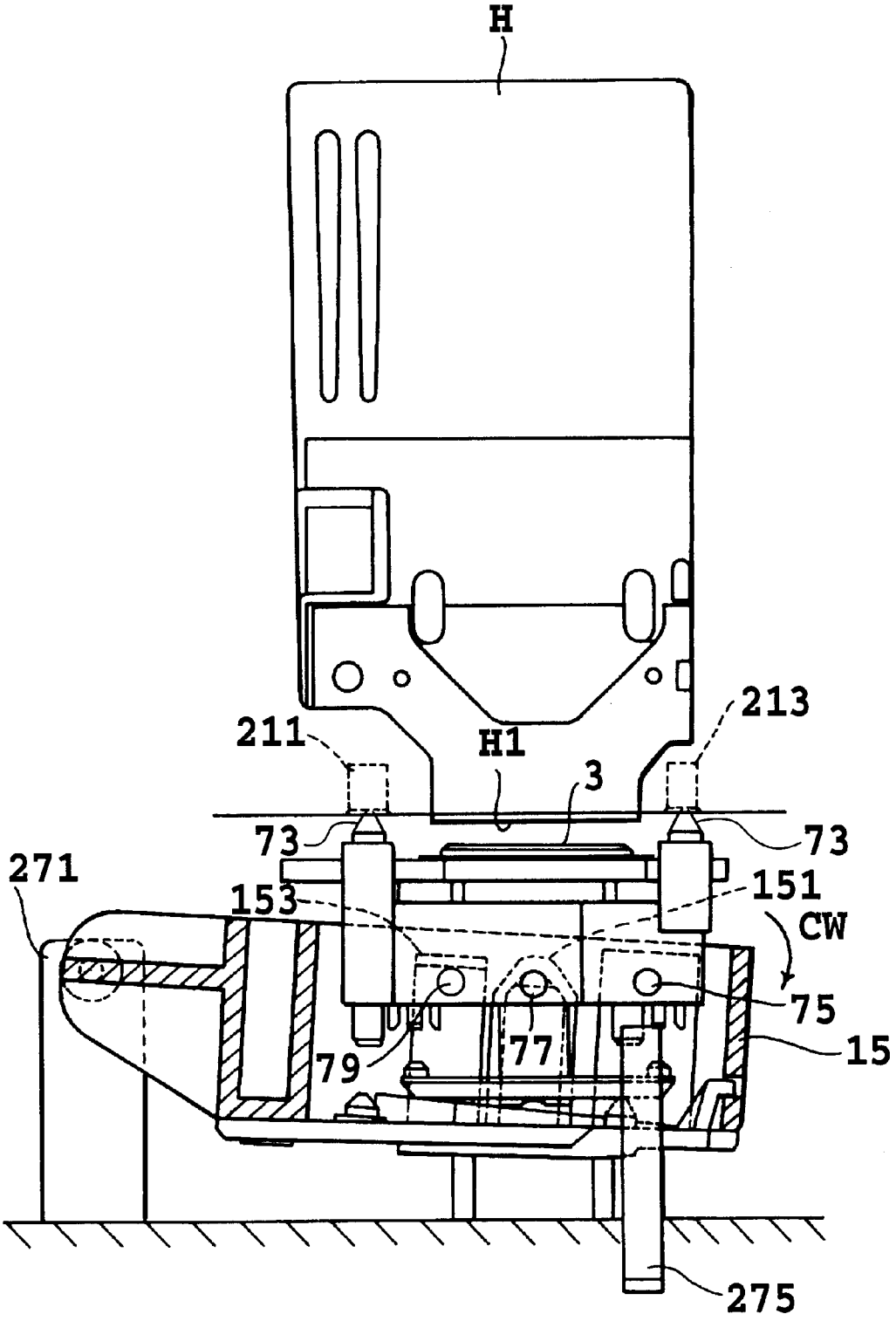
FIG. 6 is a side elevation of the cap unit.

FIG. 6 shows a condition at a moment where the positioning pins 73 start to penetrate into the hole portions 211 and 213 provided in the carriage. It should be noted that since chamfering of C 0.3 is provided for the contour line of entrance openings of the hole portions 211 and 213 in the present invention, a condition where the tip end of the positioning pins 73 enters into the hole portions 211 and 213 in a magnitude of about 0.3 mm, is defined as a condition to start a penetration into the portions 211 and 213. At this timing, the ejection opening forming surface H1 and the cap 3 are in parallel. Also, at the same timing, the guide boss 79 is in contact with the second stopper 153. As a result, the cap 3 is again placed in parallel with the ejection opening forming surface H1. It can be understood that since the axes of the positioning hole portions 211 and 213 and the axes of the positioning pins 73 are oriented in parallel, the positioning can be done accurately and the allowable magnitude of the relative position error between the hole portions 211 and 213 and the positioning pins 73 becomes maximum.

Furthermore, the rotational moment in the clockwise (CW) direction has to be applied to the cap guide 7 during the transition from the cap opening state to the positioning initiating state. During this transition, it is clear that the rotational moment becomes minimum in the condition shown in FIG. 6. Accordingly, the fact that the rotational moment in the clockwise (CW) direction is certainly caused in the condition shown in FIG. 6, will be proven hereinafter.

In the condition shown in FIG. 6, the rotational moment on the cap guide 7 is applied only by the cap casing spring 17. Therefore, the consideration is given only for the cap casing spring 17. Here, among four cap casing springs 17, the lengths of two springs on the left side (amongst, one is overlapped with another spring on the proximal side and thus is hidden) are 10.87 mm and accordingly the loads thereon are 19.79 gf. On the other hand, the lengths of two springs on the right side (amongst, one is overlapped with another spring on the proximal side and thus is hidden) are 11.94 mm and accordingly the loads thereon are 14.09 gf. Also, a distance from the guide boss 77 to the guide boss 75 is 9 mm, and a distance from the guide boss 77 to the guide boss 79 is 16.5 mm. At this time, a tolerance of the spring load of the cap casing spring 17 is assumed to be 20% including the margin, it should be understood that the rotational moment in the clockwise (CW) direction acting around the guide boss 77 is 218 gf•mm at minimum. Accordingly, in the transition state from FIGS. 4 to 6, it has been proven that the rotational moment in the clockwise (CW) direction is certainly act on the guide boss 77 of the cap guide 7.

Figure 7:
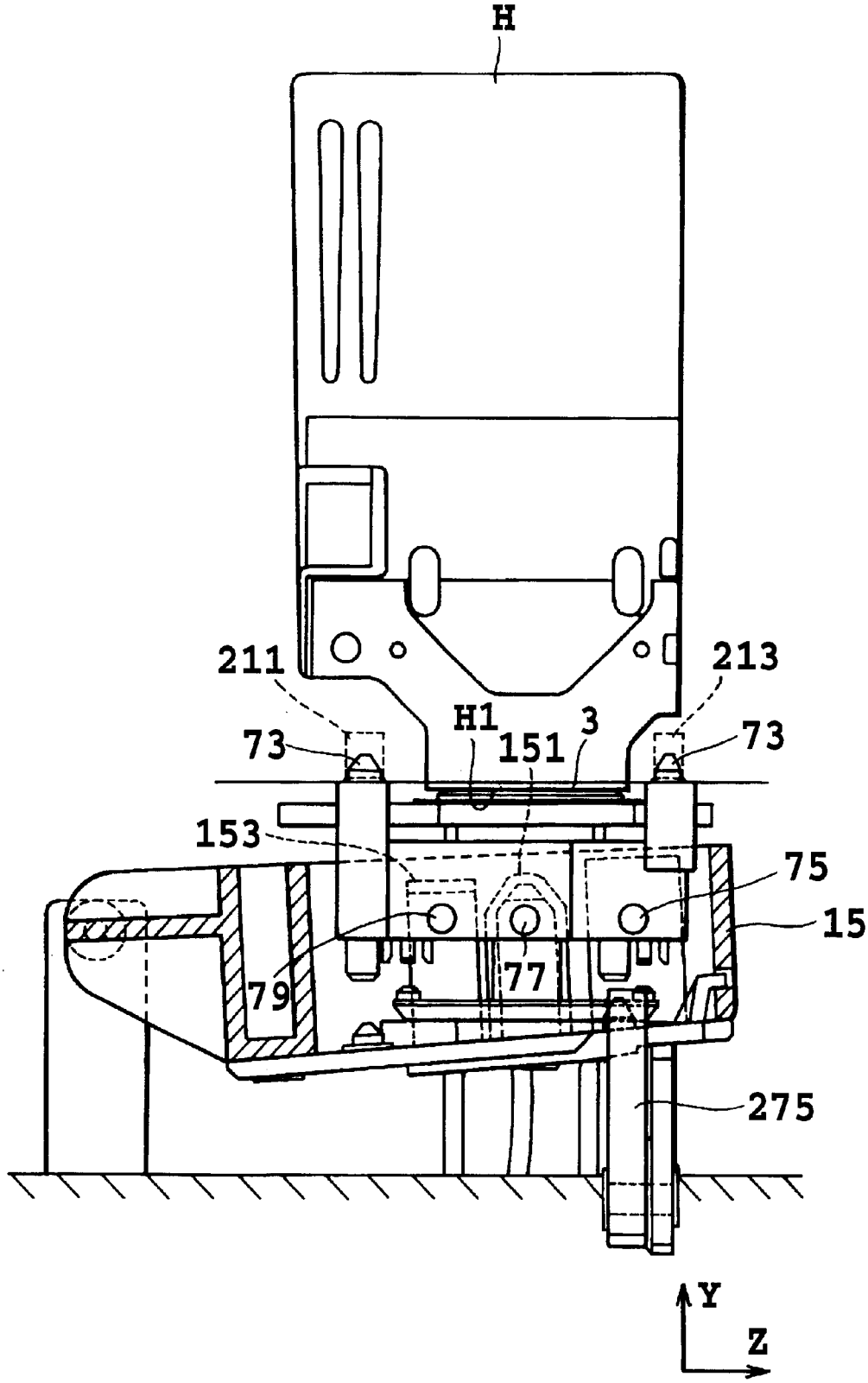
FIG. 7 is a side elevation of the cap unit at a cap closing state.

FIG. 7 is an illustration showing the cap closing condition. In the shown embodiment, after the full insertion of the positioning pins 73 into the hole portions 211 and 213 up to the route portion thereof, the contact of the cap 3 and the ejection opening forming surface H1 is initiated. At this time, the cap spring 9 is deflected in a predetermined magnitude to make the load value thereof to 280 gf. From FIG. 7, it should be appreciated that the guide bosses 75 and 79 are not in contact with the first and second stoppers 275 and 153, and the guide boss 77 is shifted away from the bottom portion of V-shaped groove of the guide portion 151 of the cap casing 15 and is movable in Y and Z directions.

Figure 8:
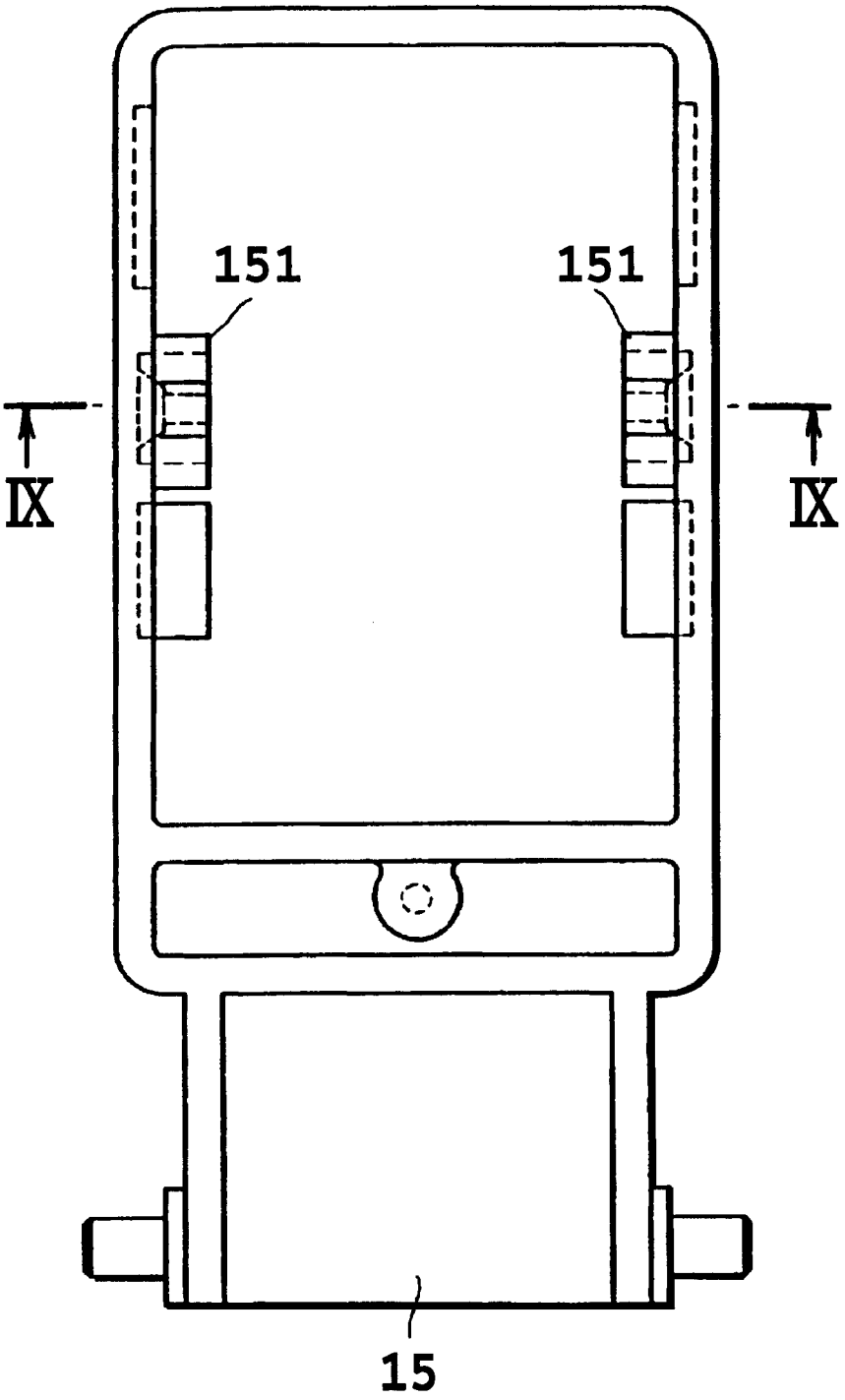
FIG. 8 is a top plan view of a cap casing.
Figure 9:
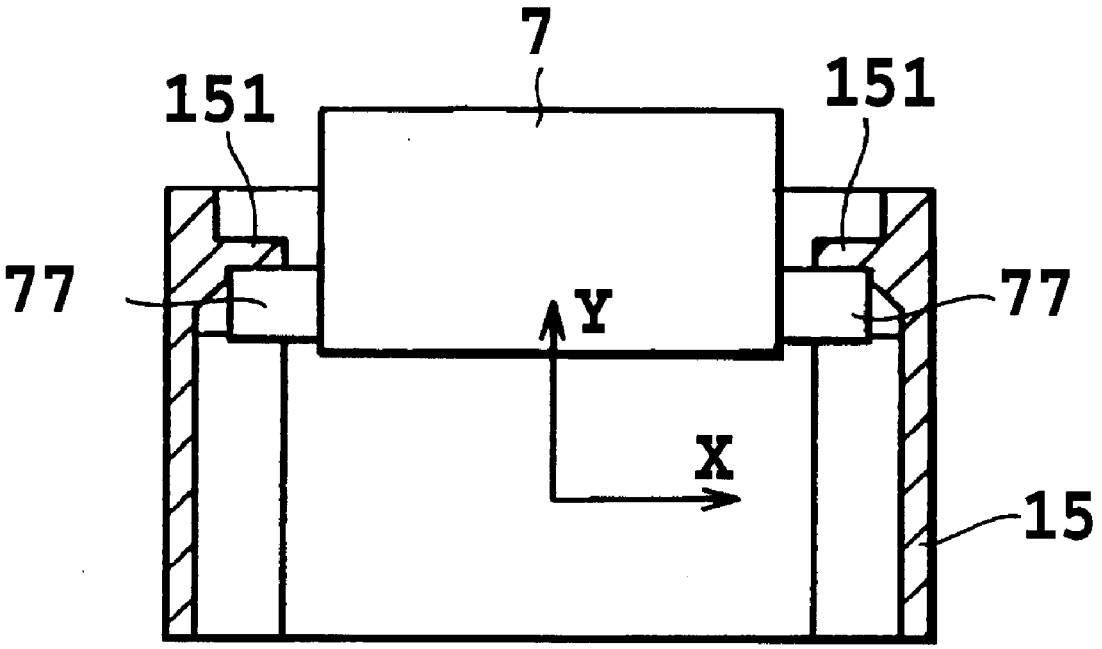
FIG. 9 is a diagrammatic illustration taken along line IX—IX of FIG. 8 showing a relationship between the cap casing and the cap guide at the cap closing state.
Figure 10:
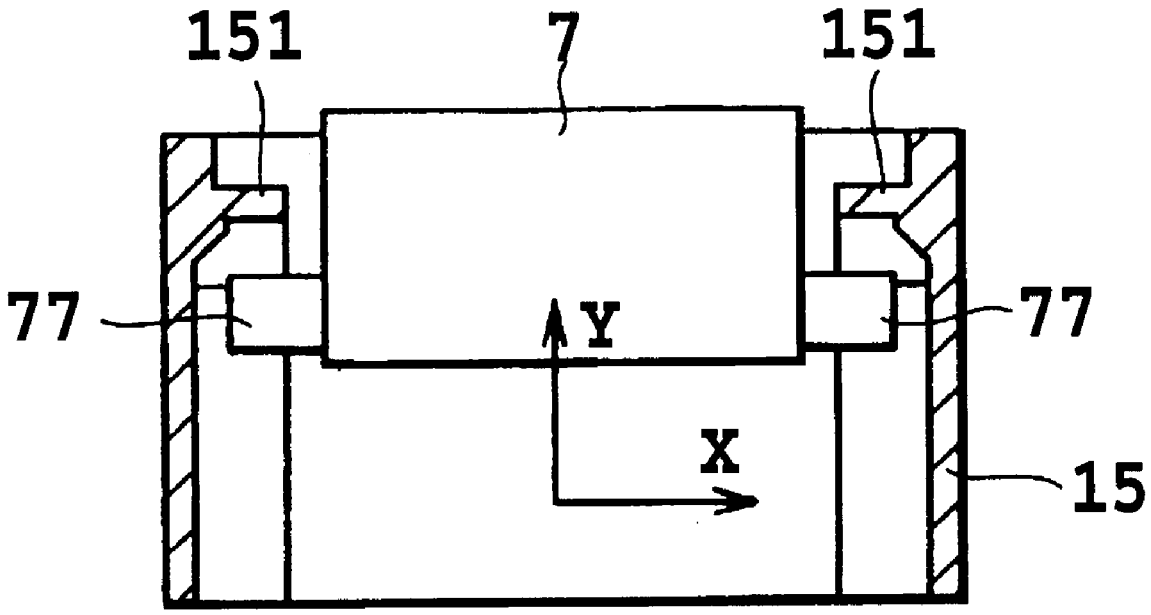
FIG. 10 is a diagrammatic illustration similar to FIG. 9, showing a relationship between the cap casing and cap guide at the cap closing state.

On the other hand, FIGS. 8, 9 and 10 are diagrammatic illustration showing a positional relationship between the cap casing 15 and the cap guide 7. FIGS. 9 and 10 are the sections of the cap casing 15 as taken along an one-dotted line (IX—IX) of FIG. 8. Here, FIG. 9 shows a condition where the guide boss 77 is placed within the bottom portion of the V-shaped groove of the guide portion 151 of the cap casing 15, as typically represented by the cap opening. As can be clear from FIG. 9, the cap 7 is restricted its motions in X-direction and Y-direction in the drawing and thus is held in the predetermined position with high precision. On the other hand, FIG. 10 shows a condition typically represented by cap closing, in which the guide boss 77 is moved away from the bottom portion of the V-shaped groove of the guide portion 151 to be movable in X-direction and Y-direction.

Accordingly, as can be clear from FIG. 4 to FIG. 10, with the construction in the shown embodiment, the cap 3 accurately fixed to the predetermined position at the cap opening state is held in place until at least the positioning initiation between the cap 3 and the head H. On the other hand, in the cap closing step, since clearances are formed between the guide portions 151 and 153 formed in the cap casing 15 and the cap guide bosses 75, 77 and 79 provided in the cap guide 7, the cap 3 becomes movable within a predetermined range with respect to a direction parallel to the ejection opening forming surface H1. Also, by the deflection of the cap spring 9 in the direction perpendicular to the ejection opening forming surface H1, the positioning error can be accommodated. With such construction, the relative position error between the cap unit C and the head unit A in the parallel direction can be accepted up to 1.25 mm at the most.

Figure 11:
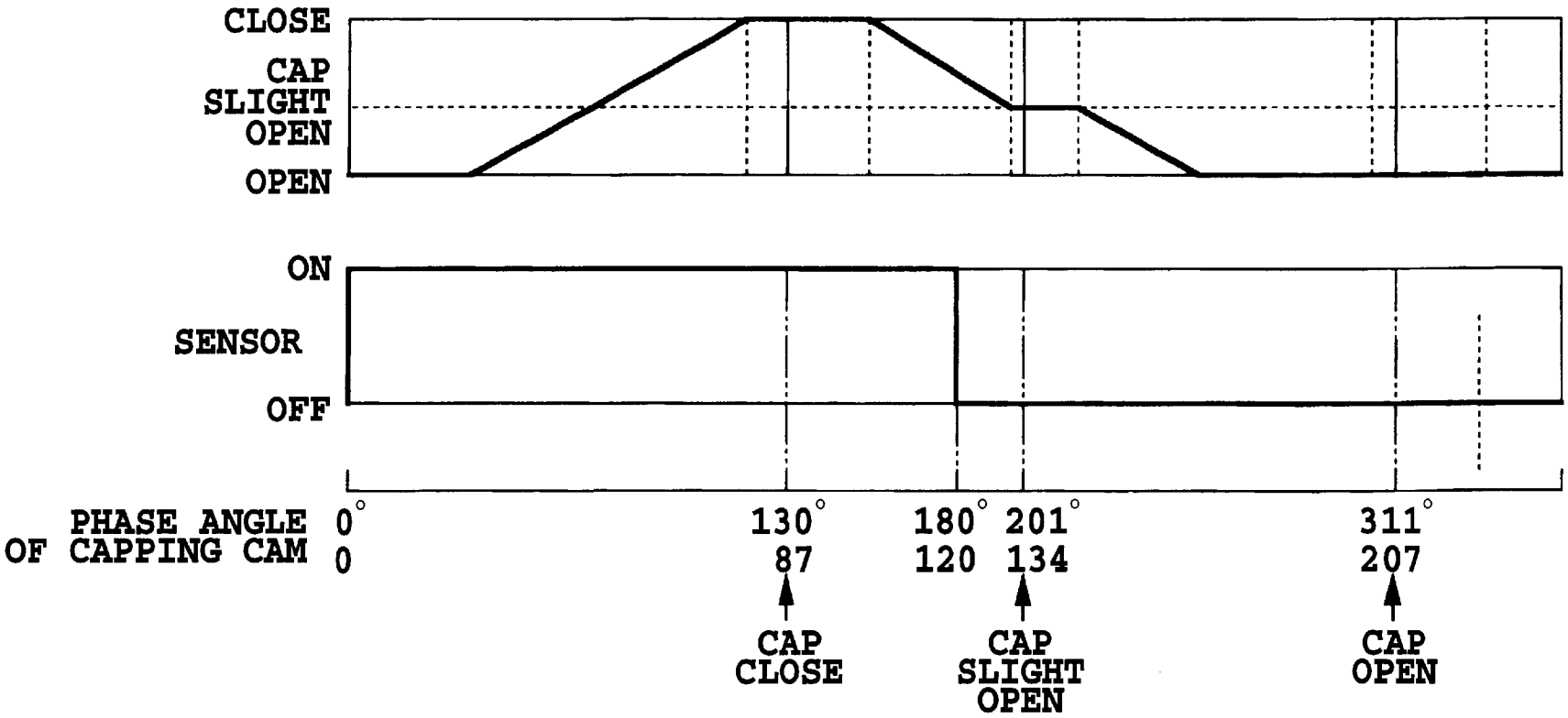
FIG. 11 is an illustration showing a cap opening and closing operation and a relationship between a cam chart of capping cam and number of steps of a motor.

FIG. 11 is a cam chart of the capping cam 23 and a timing chart of a signal to be outputted by a photo interrupter (not shown) by a not shown sensor cam. Here, "cap slight open" in the chart is a step, in which the cap 3 is slightly moved away from the ejection opening forming surface H1 after the suction of the ink from the ink ejection openings formed in the head by generating the vacuum within the cap by the vacuum generating device, namely the ink within the cap 3 is certainly sucked toward the tube portion 33 for minimizing a residual ink in the cap by slightly opening the cap 3. Furthermore, the motor as the driving power source is forty-eight steps of a stepping motor of 2—2 phase driven at a speed of 300 ppS. A reduction ratio of the capping cam and the sensor cam with respect to the motor is ⅕.

FIGS. 12 to 16 are the flowcharts showing one example of an ejection recovery process in the shown embodiment.

Figure 12:
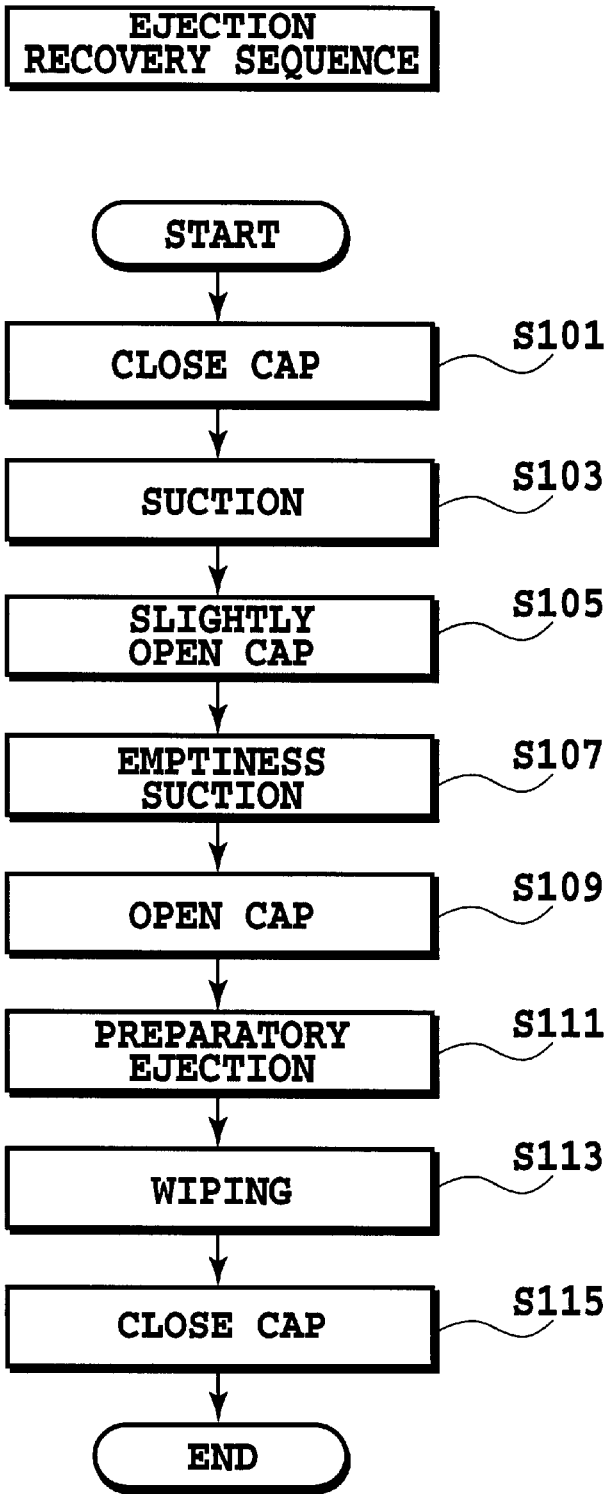
FIG. 12 is a flowchart showing a sequence of an ejection recovery process.

FIG. 12 is a flowchart showing the ejection recovery process. At first, at step S101, the cap is closed. Then, at step S103, the suction by the vacuum generating means is performed. After slightly opening of the cap at step S105, the further vacuum is generated to certainly suck the ink residing within the cap 3 at step S107. Then, at step S109, the cap 3 is opened completely. Subsequently, at step S111, the preparatory ejection is performed within the cap 3, and at step S113, the ejection recovery processing device P is reciprocated in the direction perpendicular to the paper surface of FIG. 1 to perform the wiping of the head H. Finally, at step S115, the shown process the ends after closing of the cap 3.

Figure 13:
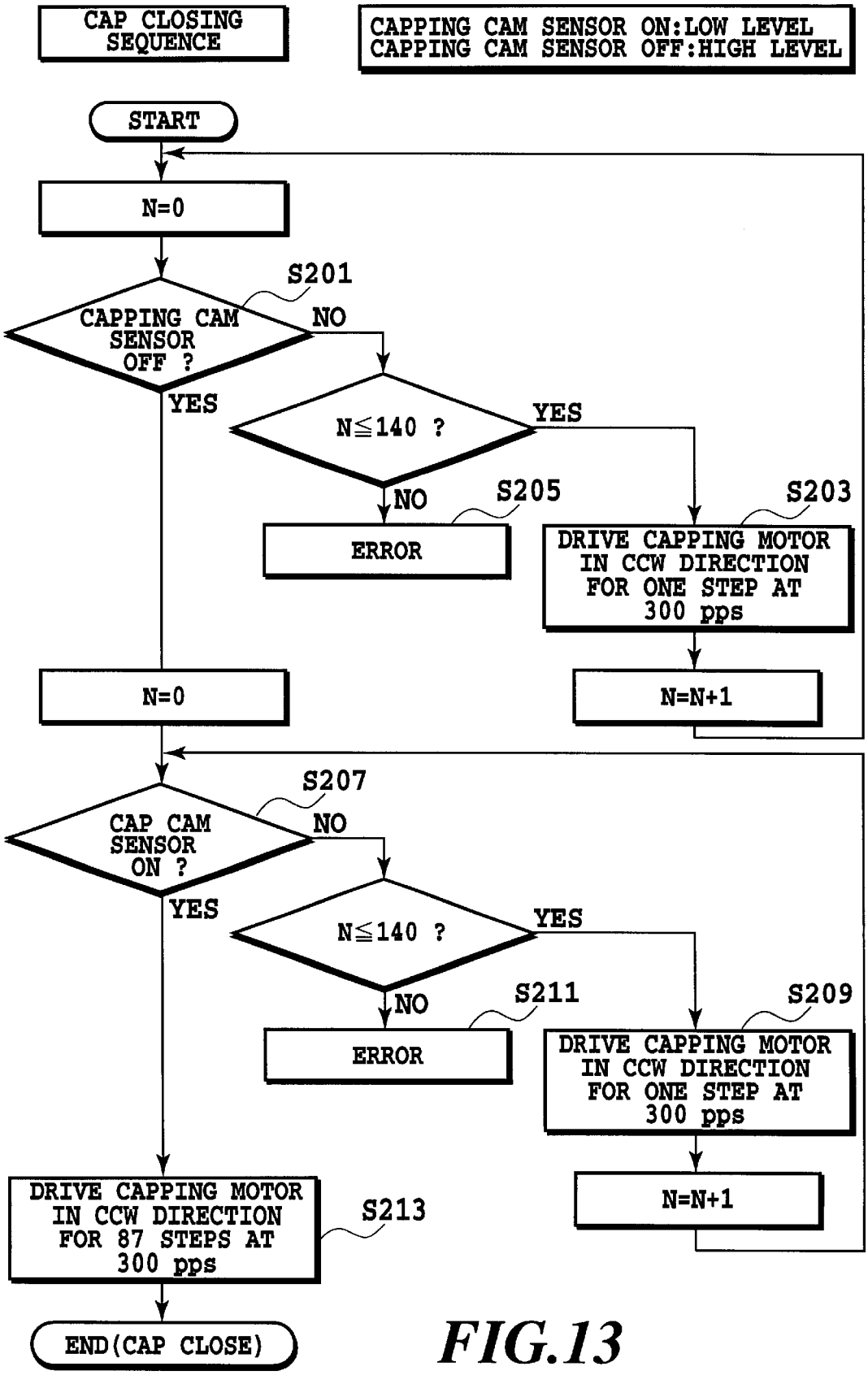
FIG. 13 is a flowchart showing a sequence of cap closing.

FIG. 13 is a flowchart showing a process for performing cap closing. At first, at step S201, the OFF state of the capping cam sensor (photo interrupter) is confirmed. If the capping cam sensor is not in the OFF state, the motor is driven in the counterclockwise (CCW) direction at step S203. If the capping cam sensor is not turned OFF within a hundred forty steps, an error process is performed at step S205. Next, at steps S207 and S209, the motor is driven in the counterclockwise (CCW) direction for a hundred forty steps at the maximum until the capping cam sensor is turned ON. Here, unless the capping cam sensor is not turned ON within a hundred forty steps, the error process is performed at step S211. Finally, by driving the motor for eighty-seven steps in the counterclockwise (CCW) direction at step S213, the cap closing process is terminated.

Figure 14:
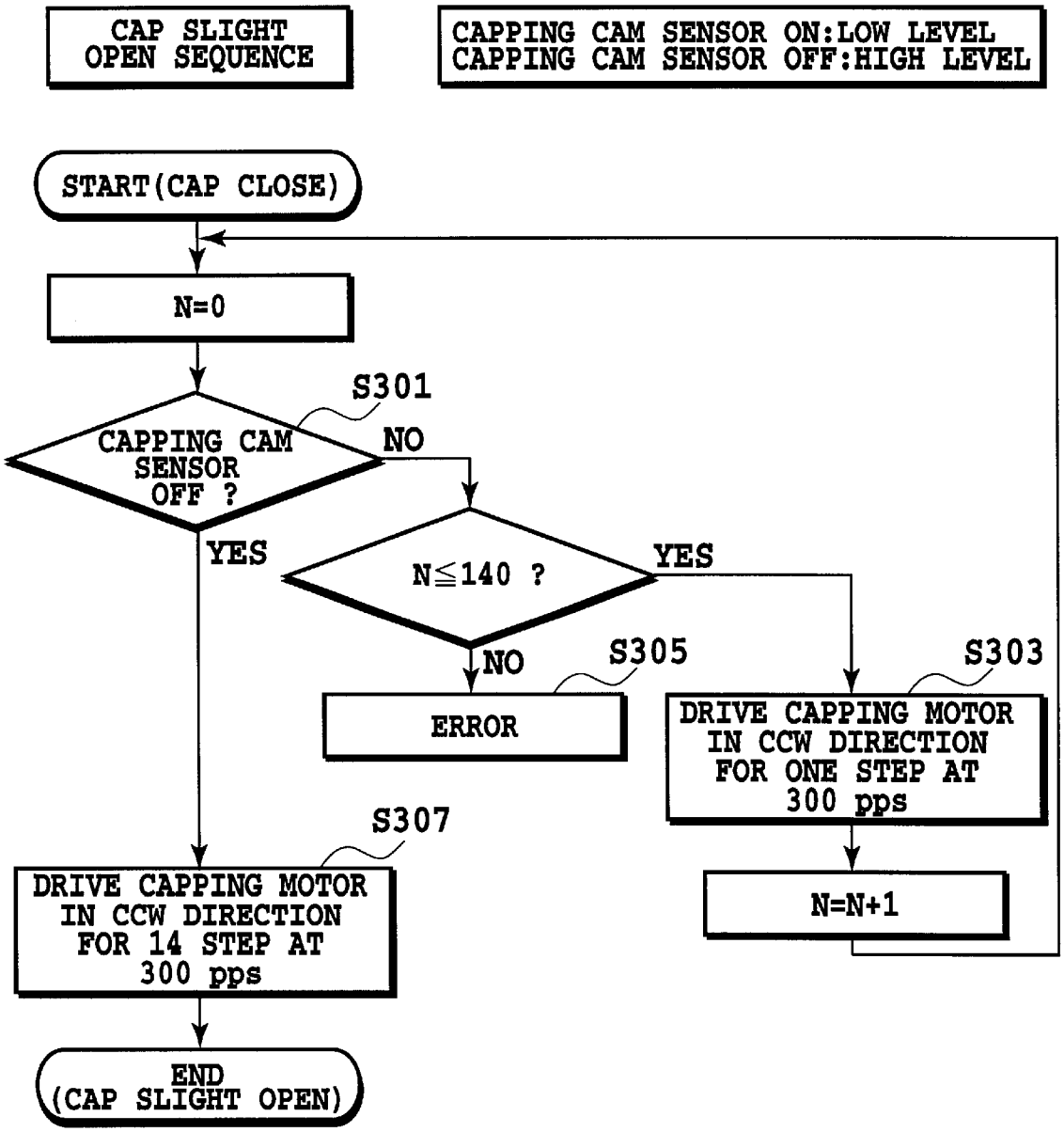
FIG. 14 is a flowchart showing a sequence of a part of a cap opening step.

FIG. 14 is a process for performing "cap slight open" from the cap closing state. At steps S301 and S303, the motor is driven in the counterclockwise direction (CCW) until the capping cam sensor is turned OFF. At this time, if the capping cam sensor is not turned OFF within a hundred forty steps, an error process is performed at step S305. Next, at step S307, the shown process is terminated by driving of the motor in the counterclockwise (CCW) direction for fourteen steps.

Figure 15:
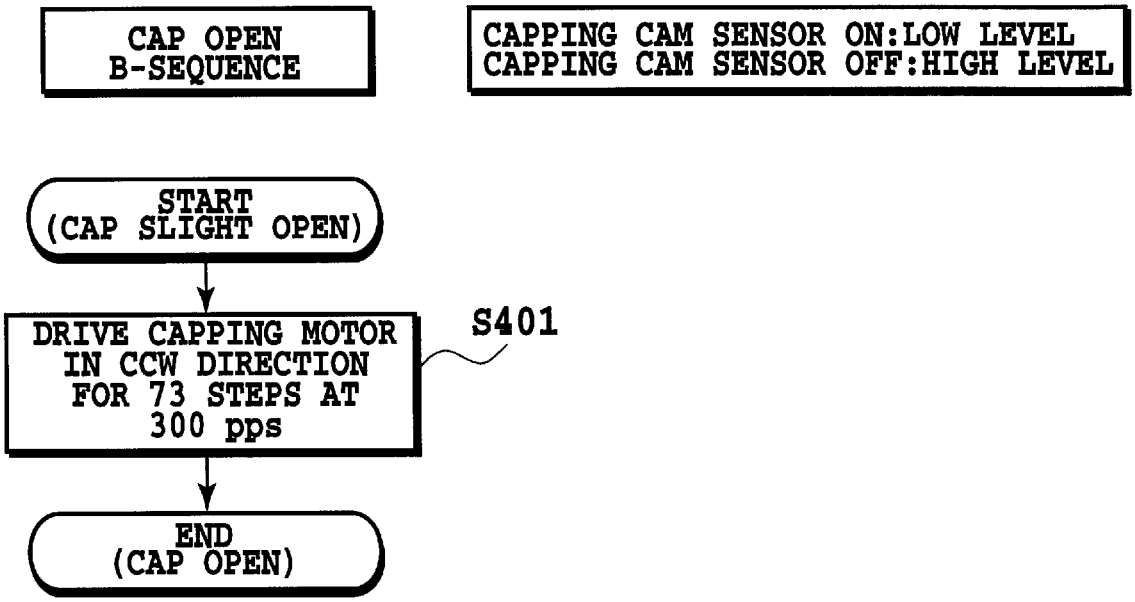
FIG. 15 is a flowchart showing a sequence of a part of the cap opening step.

FIG. 15 is a process for performing the cap opening via the "cap slight open" state from the cap closing state. At step S401, the motor is driven in the counterclockwise (CCW) direction for seventy-three steps. Then, the shown process is terminated.

Figure 16:
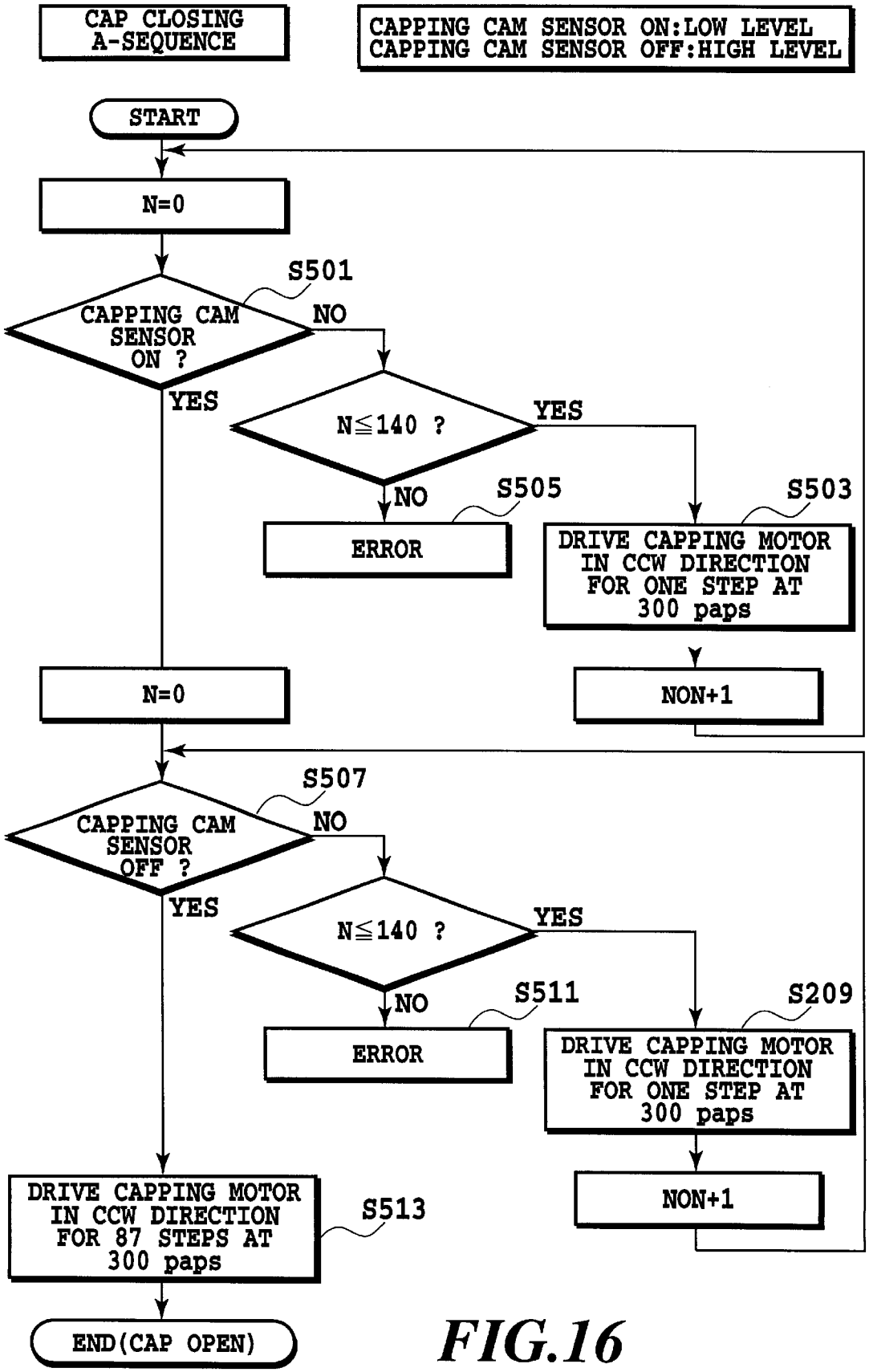
FIG. 16 is a flowchart showing a sequence of cap opening from cap closing.

FIG. 16 is a process to be performed when the cap 3 is placed in the cap opening state from the cap closing state for performing the printing, irrespective of the ejection recovery process. At first, at steps S501 and S503, the motor is driven in the counterclockwise (CCW) direction until the capping cam sensor turns ON. At this time, if the capping cam sensor is not turned ON within a hundred forty steps, the error process is performed at step S505. Subsequently, at steps S507 and S509, the motor is driven in the counterclockwise (CCW) direction until the capping cam sensor is turned OFF. At this time, the error process is performed at step S611 unless the capping cam sensor is turned OFF within a hundred-forty steps. Next, the shown process is terminated by driving the motor for eighty-seven steps at step S513 and by opening the cap.

Figure 17:
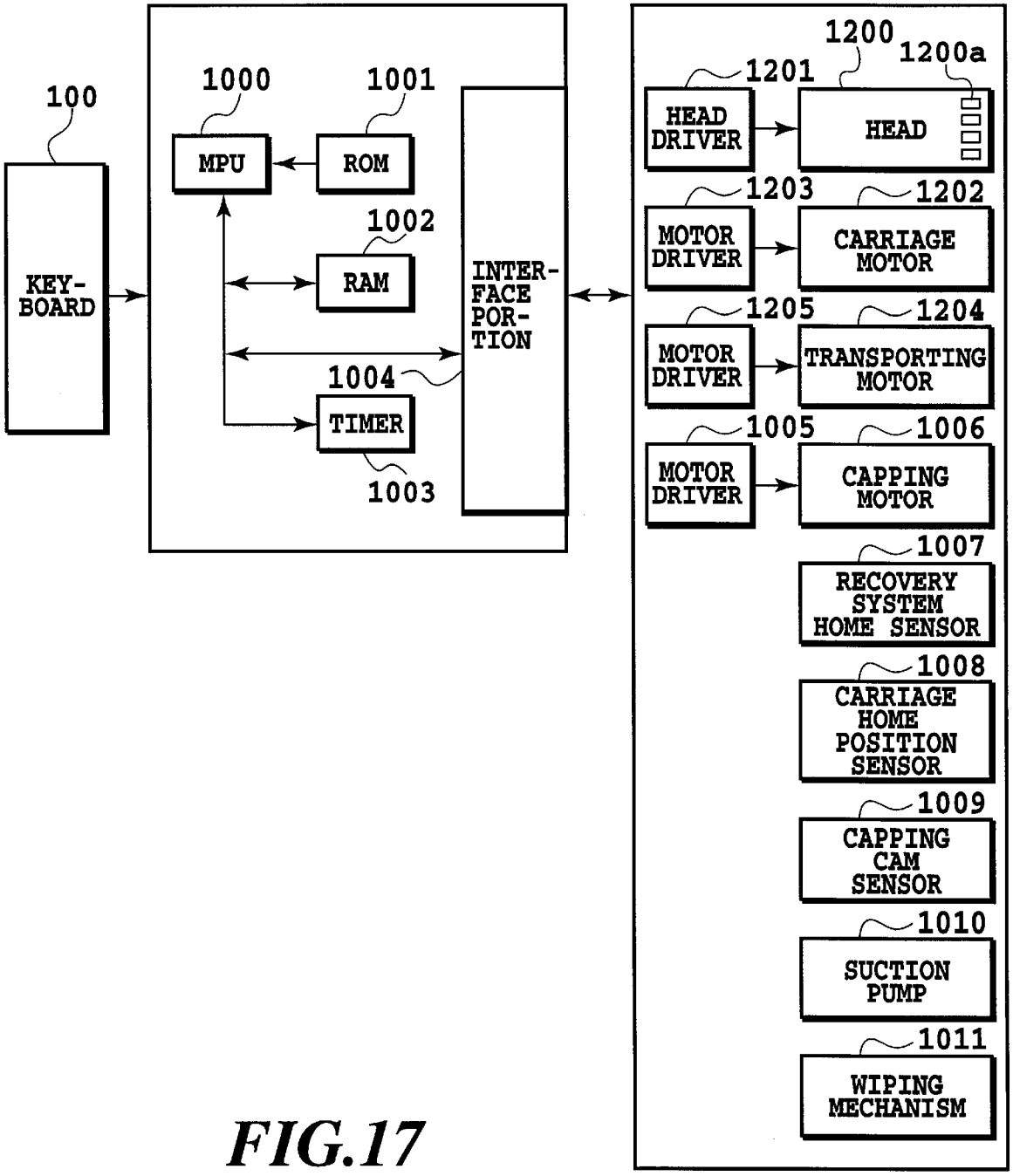
FIG. 17 is a block diagram of the ink-jet printing apparatus according to the present invention.

FIG. 17 is a block diagram showing a construction of a control system of the shown embodiment of the printing apparatus.

At first, the capping cam is driven by a capping motor 1006. Also, phases and so on of the head unit, the ejection recovery device, the capping cam can be known on the basis of the detection of the respective home position sensors 1007 and 1008 or the capping cam sensor 1009. Furthermore, the reference numeral 1010 denotes a suction pump of the ejection recovery processing device, and 1011 denotes a wiping mechanism. On the other hand, the reference numeral 1000 denotes MPU controlling respective portions, 1001 denotes ROM storing programs and the like corresponding to a control procedure, 1002 denotes RAM used as a work area in execution of control, 1003 denotes a timer for measuring a time, and 1004 denotes an interface portion. It should be noted that, in the shown embodiment of the printing apparatus, the command data and so on can be inputted through a keyboard 100. The reference numeral 1200 denotes a printing head which is constructed to arrange a plurality of ejection openings and to have an electrothermal transducer 1200 generating a thermal energy used for the ink ejection from each of the ejection openings, 1201 denotes its driver, 1202 denotes a motor for driving the head unit or the carriage in the direction perpendicular to the paper surface of FIG. 1, 1204 denotes a motor for generating a driving force for transporting the printing medium, 1203 and 1205 denote drivers for the respective motors.

Figure 18:
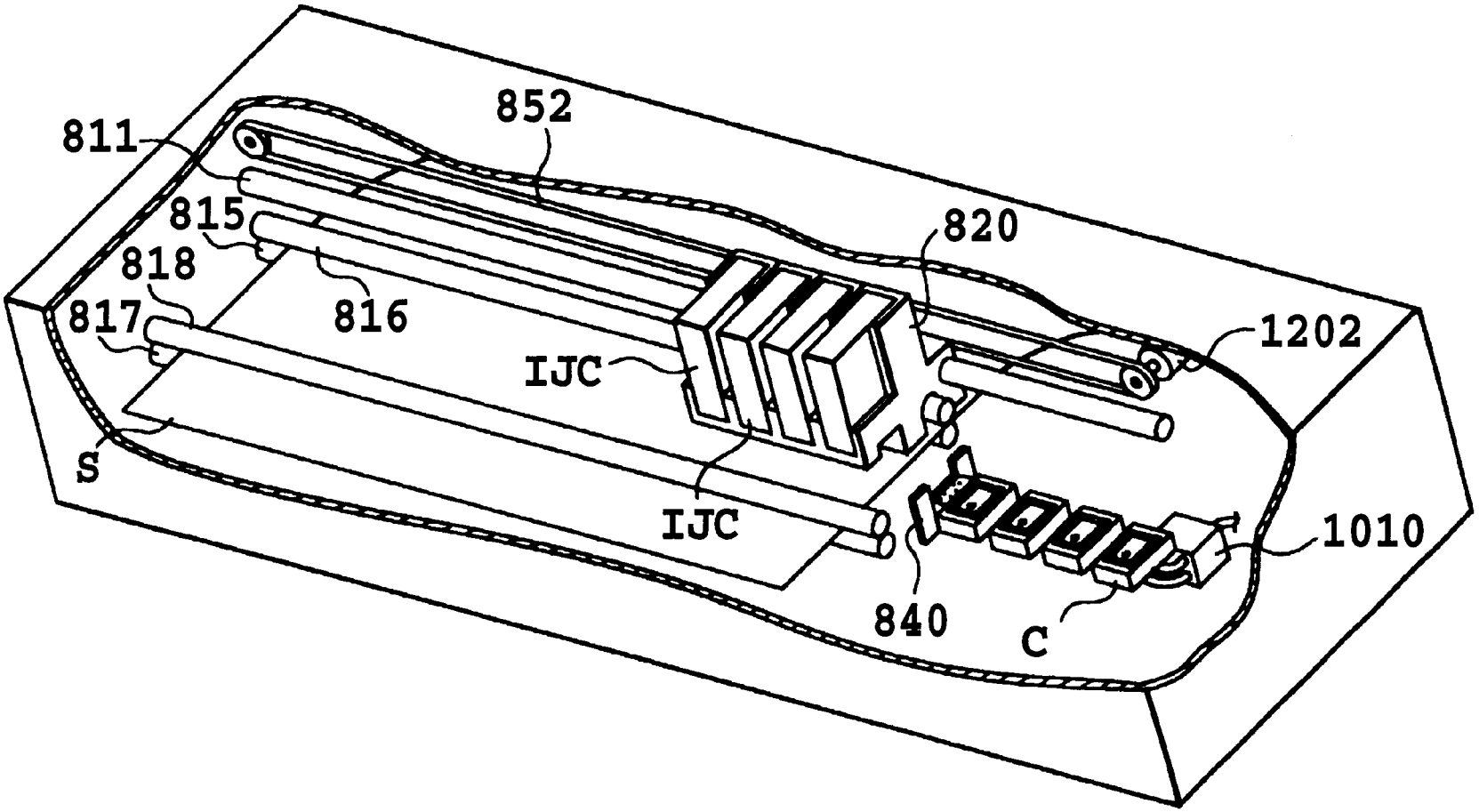
FIG. 18 is a perspective view showing the ink-jet printing apparatus according to the present invention.

FIG. 18 is a general perspective view showing one embodiment of an ink-jet printing apparatus, to which the shown embodiment of the head unit and the cap unit are applied. The printing apparatus is a full color serial type printing apparatus having an exchangeable ink tank integrated type printing head cartridge corresponding to four colors of black (Bk), cyan (C), magenta (M) and yellow (Y).

In FIG. 18, IJC is four printing head cartridges corresponding to respective inks of Y, M, C, Br, in each of which the printing head and the ink tank for storing the ink to be supplied to the printing head are integrally formed. Such printing head cartridge IJC is detachably installed on a carriage 820. The carriage 820 slidably engages with a guide shaft 811 for the sliding movement therealong and is connected to a part of the driving belt 852 driven by a carriage motor 1202. Thus, the head cartridge IJC can be moved along the guide shaft 811 for scanning. The reference numerals 815, 816, 817 and 818 are the transporting rollers respectively extending substantially in parallel with the guide shaft 811 on the distal side and proximal side of the printing region, in which the printing head cartridge IJC is scanned. The transporting rollers 815, 816, 817 and 818 are driven by a not shown auxiliary scanning motor for transporting the printing medium S. The printing medium S thus transported forms a printing surface opposed to a surface, in which the ejection opening forming surface H1 of the printing head cartridge IJC is arranged.

The ejection recovery processing device P is provided in opposition to a region where the printing head cartridge can be moved, which the region is located adjacent to the printing region, in which the printing is performed by the printing head cartridge IJC. The capping units C of the ejection recovery processing device P are arranged respectively corresponding to a plurality of cartridges IJCs having the printing heads H for opening and closing the cap by its vertical motion or pivotal motion. Then, when the carriage 820 is in a home position, the cap 3 is fitted on the printing head J for capping. Also, in the ejection recovery processing device P, the reference numeral 840 denotes a blade as the wiping member. The blade 840 is vertically movable by the wiping mechanism 1011 of FIG. 17, for example. By this, the blade 840 can perform the wiping of the ejection opening forming surface H1. The reference numeral 1010 denotes a pump unit for sucking the ink in the ejection openings of the printing head H1 and in the vicinity thereof via the capping unit C.

As set forth above, for the present invention, the ink-jet printing apparatus includes the cap covering the surface, in which the ink ejection openings of the ink-jet printing head are formed, and the cap supporting member which is pivotable with holding the cap for opening and closing relative to the ink-jet printing head. The cap can take the first position in the cap opening state where the ejection opening forming surface and the cap are placed in parallel state, and the second position at initiation of positioning, in the transition state from the opening state to the closing state of the cap. Therefore, upon opening and closing the cap, the magnitude of pivoting of the cap supporting member can be restricted to be minimum. Also, in the transition state from the cap opening state to the cap closing state, the cap can be placed in parallel condition to the head, twice, space saving of the apparatus can be realized. Upon the positioning between the head unit and the capping unit, the cap or a part of the capping unit (including the member associated with positioning) and the head or a part of the heat unit (including the member associated with positioning) can be placed in parallel to improve performances in the preparatory ejection and the positioning.

The present invention has been described in detail with respect to the preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. An ink-jet printing apparatus comprising:

a cap for capping an ink ejection opening for electing ink provided on a head surface of an ink-jet printing head by contacting a capping surface of said cap onto said head surface;

a cap supporting member for supporting said cap to move said cap between an open state and a closed state against said head surface of said ink-jet printing head by rotating on an axis; and posture control means for controlling posture of said cap for placing said capping surface in parallel to said head surface at least at a first position and at a second position different from the first position, the first position and the second position being in the open state of said cap.

2. An ink-jet printing apparatus as claimed in claim 1, wherein said first position is a position at an opening state of said cap, and a second position is a position at an initiating state of cap positioning of said cap with respect to said surface for performing the closing of said cap.

3. An ink-jet printing apparatus as claimed in claim 1, wherein said posture control means includes:

rocking means provided on said cap supporting member for rocking said cap;

rotational moment applying means for applying a rotational moment to said cap for rocking motion of said cap about a rocking center of said rocking means;

a first stopper for stopping said cap at said first position with respect to said ink-jet printing head by restricting rocking motion by said rotational moment in the cap opening state during said cap is substantially in the cap opening state; and a second stopper for stopping said cap at said second position by said rotational moment for the restricting rocking motion in the cap closing state during said cap is substantially in the closing state of said cap.

4. An ink-jet printing apparatus as claimed in claim 1, which further comprises positioning means for performing relative positioning of said cap and said ink-jet printing head.

5. An ink-jet printing apparatus as claimed in claim 4, wherein said relative positioning means has projecting member on one of said capping unit or said head unit and a hole portion, in which said projecting member is inserted, on the other of said capping unit or said head unit.

6. An ink-jet printing apparatus as claimed in claim 3, wherein said rotational moment by said rotational moment applying means is applied by a spring.

7. An ink-jet printing apparatus as claimed in claim 3, which further comprises means as ejection recovery means for said ink-jet printing head, for performing preparatory ejection by said ink-jet printing head at said first position, in which said preparatory ejected ink is received within said cap.

8. An ink-jet printing apparatus as claimed in claim 7, wherein said ejection recovery means has means for discharging ink from said ejection opening by acting a suction force via said cap.

9. An ink-jet printing apparatus as claimed in claim 7, wherein said ink-jet printing head has an electrothermal transducer generating a thermal energy in response to application of an electric power to be used for ink ejection.

10. An ink-jet printing apparatus as claimed in claim 9, wherein said ink-jet printing head performs ejection of an ink toward a printing medium through said ejection openings, utilizing film boiling caused in the ink by thermal energy to be applied by said electromagnetic transducer.

* * * * *

UNITED STATES PATENT AND TRADEMARK OFFICE

CERTIFICATE OF CORRECTION

PATENT NO. : 6,260,943 B1
DATED : July 17, 2001
INVENTOR(S) : Tetsuya Ishikawa

It is certified that error appears in the above-identified patent and that said Letters Patent is hereby corrected as shown below:

Column 1,
Line 25, “words” should read -- phrase --; and
Line 43, “times” should read -- time --.

Column 2,
Line 56, “that” should read -- that it --.

Column 3,
Line 2, “that” should read -- that it --;
Line 20, “electromagnetic” should read -- electrothermal --;
Line 48, “a” should read -- as a --;
Line 50, “an” should read -- as a --; and
Line 61, “elevation” should read -- elevation view --.

Column 4,
Line 39, “elevation” should read -- elevation view --.

Column 5,
Line 31, “color” should read -- cover --; and
Line 39, “for” should read -- to be -- .

Column 6,
Line 28, “dies” should read -- sides --;
Line 51, “capping plate 19” should read -- cap plate 13 --; and
Line 55, “of” should read -- view of --.

Column 7,
Line 21, “post 75,” should read -- boss 75, --.

Column 8,
Line 26, “act” should read -- acted --; and
Line 41, “illustration” should read -- illustrations --.

Column 10,
Line 33, “transducer 1200” should read -- transducer disposed therein --; and
Line 49, “Br,” should read -- Bk, --.

UNITED STATES PATENT AND TRADEMARK OFFICE

CERTIFICATE OF CORRECTION

PATENT NO. : 6,260,943 B1
DATED : July 17, 2001
INVENTOR(S) : Tetsuya Ishikawa

It is certified that error appears in the above-identified patent and that said Letters Patent is hereby corrected as shown below:

Column 11,
Line 34, “twice” should read -- thus --; and
Line 52, “electing” should read -- ejecting --.

Column 12,
Line 8, “and a” should read -- and said --;
Line 47, “acting” should read -- applying --; and
Line 57, “electromagnetic” should read -- electrothermal --.

Signed and Sealed this

Twenty-fifth Day of June, 2002

*Attest:*

*Attesting Officer*

JAMES E. ROGAN
*Director of the United States Patent and Trademark Office*